United States Patent [19]

Ovens

[11] Patent Number: 5,029,552

[45] Date of Patent: Jul. 9, 1991

[54] CONTAINER ATTACHMENT DEVICE FOR APPLYING PLASTER OR CEMENT TO A TAPE

[76] Inventor: Melvin L. Ovens, 15855 - 84th Avenue, Surrey, British Columbia, Canada, V3S 2N8

[21] Appl. No.: 501,287

[22] Filed: Mar. 30, 1990

[51] Int. Cl.[5] ..... B05C 3/12; B05C 19/02; B65C 11/04

[52] U.S. Cl. ..... 118/419; 118/428; 156/578

[58] Field of Search ..... 118/419, 423, 424, 428, 118/413, DIG. 17; 156/71, 278, 390, 391, 574, 578; 427/207.1, 434.4

[56] References Cited

U.S. PATENT DOCUMENTS

| | | | |
|---|---|---|---|
| 958,284 | 5/1910 | Plant | 118/419 |
| 2,348,166 | 5/1944 | Cavanaugh et al. | 118/419 |
| 2,458,297 | 1/1949 | Petty | 118/419 |
| 3,344,770 | 10/1967 | Schaefer | 118/419 |

*Primary Examiner*—David A. Simmons
*Assistant Examiner*—Chester T. Barry
*Attorney, Agent, or Firm*—John Russell Uren

[57] ABSTRACT

A container attachment device for applying plaster or cement to a tape passes the tape through a pail of wet cement or plaster and has a doctor blade to control the thickness and evenness of the wet cement on the tape. The device comprises an elongate housing having a clip to engage the side of a pail or the like adapted to contain wet cement or the like, the housing extending into the interior of the pail. An arm extends outwards from a top portion of the housing above the clip. The arm has a support adapted to hold a roll of tape. Rollers are provided on the elongate body for guiding tape from the roll down to the lower end of the elongate housing in the pail, and upwards out of the pail, and the doctor blade ensures that an even thickness of wet cement or the like is applied to the tape before leaving the pail.

8 Claims, 2 Drawing Sheets

CONTAINER ATTACHMENT DEVICE FOR APPLYING PLASTER OR CEMENT TO A TAPE

INTRODUCTION

The present invention relates to the application of tape in drywalling and more specifically to a device for applying cement or plaster to a tape which is then applied over the joints between adjacent panels.

BACKGROUND OF THE INVENTION

In the past, the application of drywall joint tape takes place after wet cement or plaster has beer applied to the joint The tape is then placed over the wet cement, and in most cases, the tape is dry.

Another method of applying tape is to wet the tape prior to application At the present time, a length of tape is cut and dipped in a container full of water. This is often inconvenient, because the length of wet tape can be difficult to handle, and is generally too long, resulting in a waste of tape.

SUMMARY OF THE INVENTION

It is an aim of the present invention to provide a device for easily and conveniently applying an even layer of plaster or cement to a tape, which tape can then be applied to a dry wall joint.

According to the invention there is provided a container attachment device for applying plaster or cement to a tape, which device comprises an elongate housing having an upper end and a lower end; means for removably attaching the housing in an upright position to the side of a plaster or cement container with the upper end of the housing protruding from the top of the container and the lower end of the housing located towards the base of the container; means for rotatably supporting a roll of tape adjacent the upper end of the housing; a tape entry opening at the upper end of the housing; tape support means at the lower end of the housing for the passage of the tape therearound; the housing being open at its lower end for exposing one surface of a tape passing around the tape support means to plaster or cement in the container; a tape exit opening at the upper end of the housing; and doctor blade means at the lower end of the housing for spreading an even layer of plaster or cement on a surface of a tape passing around the tape support means.

One elongate side of the housing may comprise a cover which can be opened to provide access to the interior of the housing.

The tape support means at the lower end of the housing may comprise a roller.

The means for rotatably supporting a roll of tape adjacent the upper end of the housing may comprise an arm attached to the housing in proximity to the upper end thereof and extending transversely of the housing and including means for rotatably supporting a roll of tape thereon. The arm may be pivotally connected to the housing and may be moveable between an operative position in which it extends transversely of the housing and an inoperative position in which it is located against the housing.

DESCRIPTION OF PREFERRED EMBODIMENT

Figure 1:
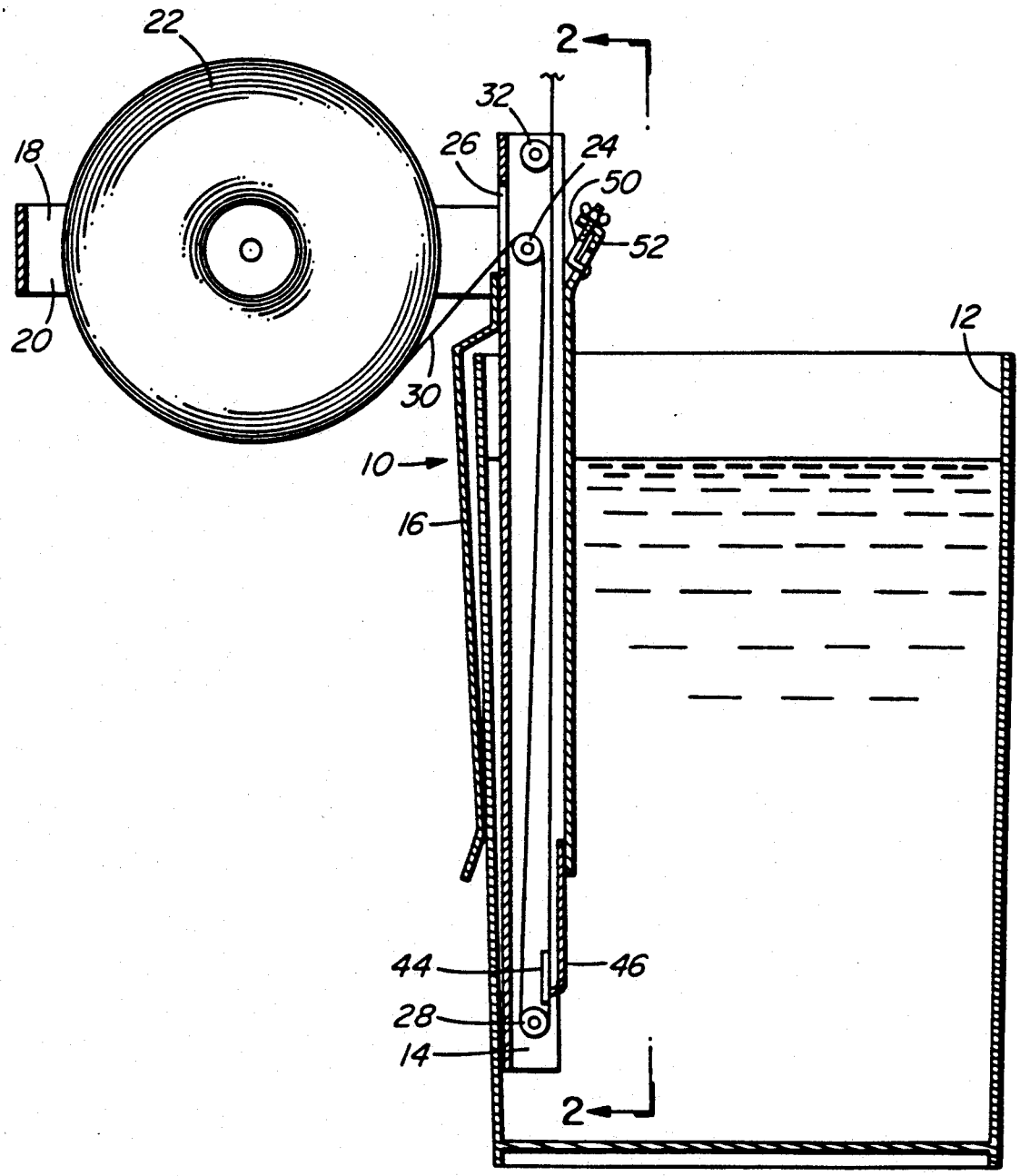
FIG. 1 is a sectional side view showing partially schematically a device for applying plaster or cement to a tape according to one embodiment of the present invention.

Referring now to FIG. 1, one embodiment of a drywall tape applicator 10 is shown clipped to a pail or bucket 12 containing wet plaster, wet cement or other material to be applied to a tape. The device 10 has a channel-shaped housing 14 with a clip 16 on the back of the housing, arranged to clip over the side wall of a pail 12 or other type of container. As can be seen in FIG. 1, the housing 14 extends down almost to the bottom of the pail 12 and also extends above the top of the pail 12. An arm 18 extends out from the housing 14 above the top of the pail and has a holder 20 for rotatably supporting a roll of tape 22 thereon. The arm 18 is pivotally connected to the housing 14 and is moveable between an operative position, which is the position shown in FIG. 1 and in which it supports a roll of tape, to an inoperative position, in which it is folded against the housing 14 with the roll of tape removed therefrom.

The roll of tape 22 is free to rotate on the holder 20 and a clip or the like (not shown) is provided to prevent the roll of tape coming off the holder 20. A first roller 24 for the tape is positioned in the housing 14 adjacent where the arm 18 is attached. A slot 26 is provided in the back of the housing so the tape can pass through the housing over the roller 24 and downwards to a bottom roller 28 almost at the lower end of the housing 14 so that it is located in the wet cement in the pail 12. The tape 30 passes over the first roller 24 down over the bottom roller 28 and then comes up to a third roller 32 which acts as a guide as the tape extends up for exiting the housing.

Figure 2:
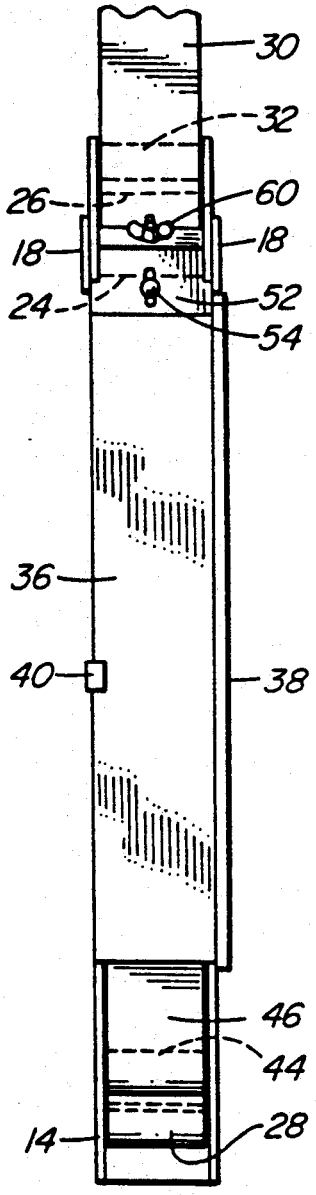
FIG. 2 is a view taken at line 2—2 of FIG. 1.

A cover plate 36 is provided with a long hinge 38 for enclosing the housing 14, as shown in FIG. 2. A catch 40 permits the cover 36 to be unlatched and swung open. The cover 36 is opened for manually loading the tape 30 over the first roller 24 down to the bottom roller 28 and up to the top roller 32.

Figure 3:
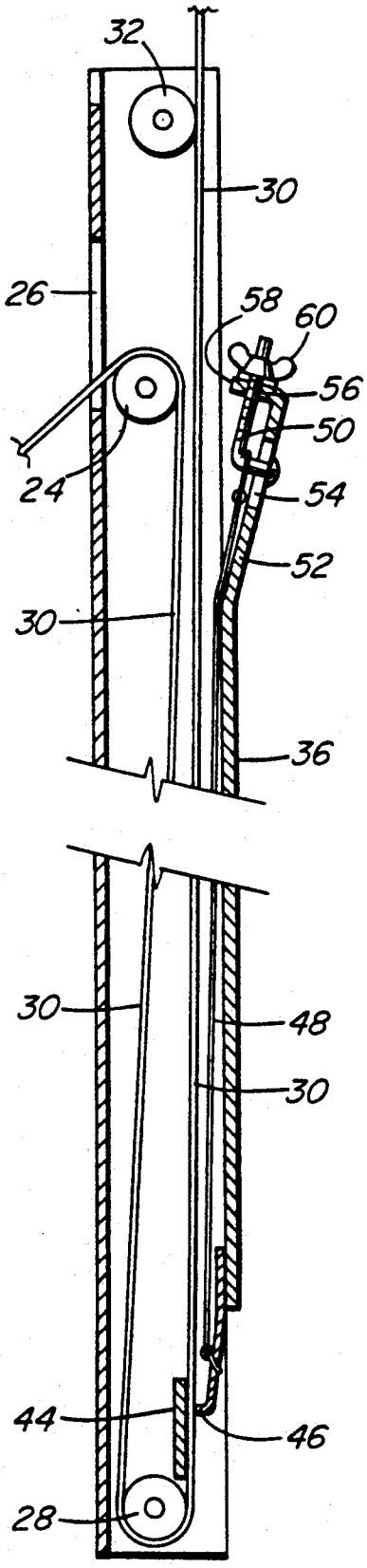
FIG. 3 is a detailed sectional side view of FIG. 1 showing the doctor blade arrangement.

A guide plate 44 is positioned in the housing 14, as shown in FIG. 3, so that the tape 30 passes over the plate 44 immediately after leaving the bottom roller 28. A doctor blade 46 is shown opposite the guide plate 44, [to provide a scraper or doctor for the wet cement on the tape 30.] The doctor blade 46 is L-shaped and flexible, joined at the top end to the bottom of the cover 36. A wire 48 is connected to the center of the doctor blade 46 and extends up to a bolt 50 on a top sloping portion 52 of the cover 36. The bolt has a right angle bend and is threaded at one end. The head of the bolt 50 is free to move up and down in a slot 54 in the sloping part on 52. The threaded portion of the bolt 50 passes through a hole 56 in a flange 50 of the sloping portion 52. A wing nut 60 adjusts the position of the doctor blade 46.

The doctor blade 46 is flexible and springs back into place when the wing nut is loosened. The space between the doctor blade 46 and the tape 30 is set to have an even thickness of cement or plaster thereon before the tape leaves the pail.

In operation a roll of tape 22 is placed on the holder 20, the cover plate 36 is swung open on the hinge 38. The tape 30 is fed over the first roller 24 down over the bottom roller 28 and up over the guide plate 44 passing the first roller 24 and behind the top roller 32. The cover 36 is closed and the catch 40 ensures that the cover remains closed. The doctor blade 46 is set for the required spacing and the device 10 is then placed in a pail or container 12 filled with wet cement or other liquid. The tape is pulled up through the wet cement and may be loaded into a pail or pot located around a user's waist before being applied to a drywall joint It has been found that the tape can be applied to the joint without the use of a trowel and torn off in appropriate lengths after having been applied to the joint.

While only preferred embodiments of the invention have been described herein in detail, the invention is not limited thereby and modifications can be made within the scope of the attached claims.

What is claimed is:

1. A container attachment device for applying plaster or cement to a tape, which comprises:

an elongate housing having an upper end and a lower end;

means for removably attaching the housing in an upright position to the side of a plaster or cement container with the upper end of the housing protruding from the top of the container and the lower end of the housing located towards the base of the container;

means for rotatably supporting a roll of tape adjacent the upper end of the housing;

a tape entry opening at the upper end of the housing;

tape support means at the lower end of the housing for the passage of the tape therearound;

the housing being open at its lower end for exposing one surface of said tape passing around the tape support means to plaster or cement in the container such that the other surface of said tape remains substantially free of plaster or cement;

a tape exit opening at the upper end of the housing; and doctor blade means at the lower end of the housing for spreading an even layer of plaster or cement on said one surface of said tape passing around the tape support means.

2. The device according to claim 1, wherein one elongate side of the housing comprises a cover which can be opened to provide access to the interior of the housing.

3. The device according to claim 1, wherein the tape support means at the lower end of the housing comprises a roller.

4. The device according to claim 1, wherein the means for rotatably supporting a roll of tape adjacent the upper end of the housing comprises an arm attached to the housing in proximity to the upper end thereof and extending transversely of the housing and including means for rotatably supporting a roll of tape thereon.

5. The device according to claim 4, wherein the arm is pivotally connected to the housing and is moveable between an operative position in which it extends transversely of the housing and an inoperative position in which it is located against the housing.

6. The device according to claim 1, wherein the doctor blade means is adjustable for varying the thickness of said layer of plaster or cement applied to the tape.

7. The device according to claim 6, including a hinged cover for the elongate housing, the hinged cover containing the adjustable doctor blade means and permitting insertion of the tape into the housing when the cover is open.

8. The device according to claim 1, wherein the housing includes a first roller adjacent the tape entry opening for receiving tape from a roll of tape;

the tape support means at the lower end of the housing further comprises a second roller at the lower end of the elongate housing for guiding tape after passing over the first roller; and a third roller at the upper end of the housing adjacent the tape exit opening for guiding tape after passing around the second roller for exiting the housing.

* * * * *